US005389731A

United States Patent [19]

Lace

[11] Patent Number: 5,389,731

[45] Date of Patent: Feb. 14, 1995

[54] ELECTROMAGNETIC MUSICAL PICKUP USING MAIN AND AUXILIARY PERMANENT MAGNETS

[75] Inventor: Melvin A. Lace, Prospect Heights, Ill.

[73] Assignee: Thomas E. Dorn, Clarendon Hills, Ill. ; a part interest

[21] Appl. No.: 90,318

[22] Filed: Jul. 13, 1993

Related U.S. Application Data

[63] Continuation-in-part of Ser. No. 000,202, Jan. 4, 1993, which is a continuation-in-part of Ser. No. 764,346, Sep. 23, 1991, abandoned, and Ser. No. 900,485, Jun. 18, 1992, Pat. No. 5,221,805, which is a continuation-in-part of Ser. No. 597,899, Oct. 10, 1990, abandoned, said Ser. No. 764,346, is a continuation-in-part of Ser. No. 597,899, Oct. 10, 1990.

[51] Int. Cl.[6] ..... G10H 3/18

[52] U.S. Cl. ..... 84/726

[58] Field of Search ..... 84/723, 725, 726, 728

[56] References Cited

U.S. PATENT DOCUMENTS 3,588,311 6/1971 Zoller .
4,283,982 8/1981 Armstrong .
4,809,578 3/1989 Lace, Jr. .

*Primary Examiner*—William M. Shoop, Jr.
*Assistant Examiner*—Jeffrey W. Donels
*Attorney, Agent, or Firm*—Dorn, McEachran, Jambor & Keating

[57] ABSTRACT

An electromagnetic pickup assembly for a musical instrument, such as a guitar, strung with ferromagnetic strings, comprises two elongated high permeability ferromagnetic (steel or iron) cores each long enough to span some but not all of the strings; preferably, there are several thin steel laminations in the core. Two electrically conductive pickup coils are wound in coil forms, usually plastic; one such coil form encompasses each core. There are two vertically magnetized main permanent magnets, each having a high energy product (BxH); each main magnet engages the bottom edge of one core and maintains that core at a given polarity. A housing or other mounting members mount the cores, the coils, and the main permanent magnets in spaced relation to the strings so that the pickup generates two magnetic fields that, together, encompass all of the strings, whereby movement of any string or combination of strings generates electrical signals in the coils. Auxiliary permanent magnets of low energy product (BxH) material shield the sides of the cores and their coils; one such auxiliary permanent magnet may shield both cores.

15 Claims, 4 Drawing Sheets

FIG. 1
PRIOR ART
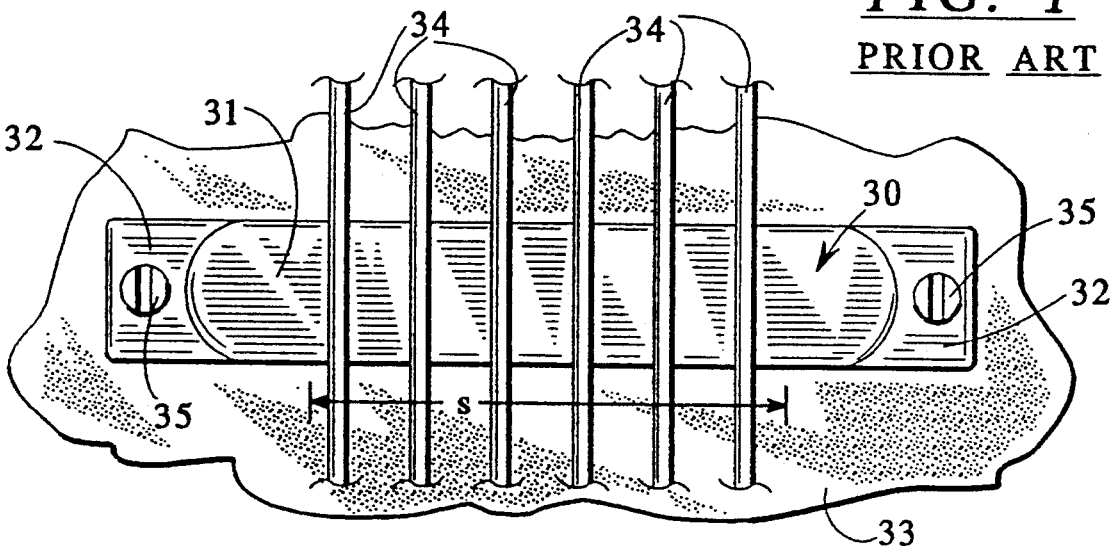
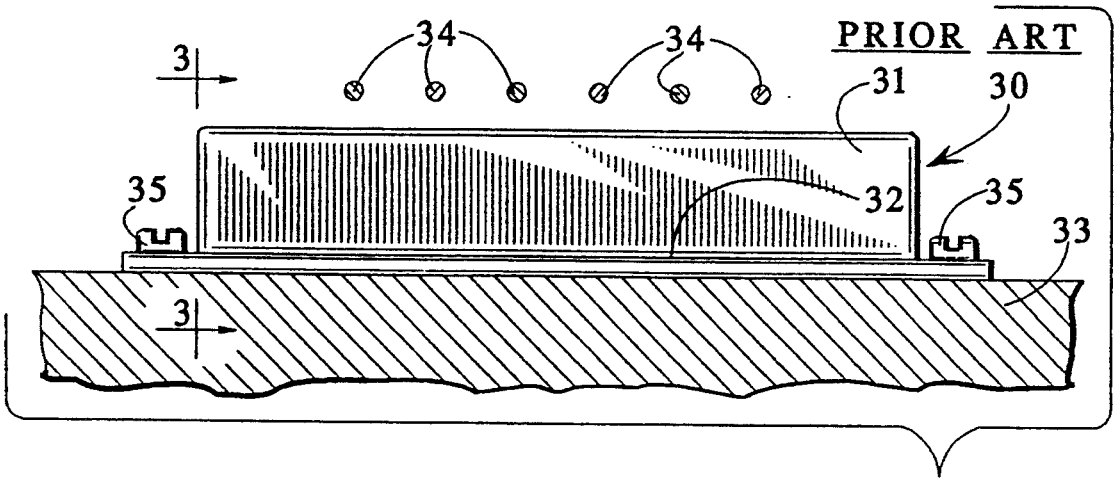
FIG. 2
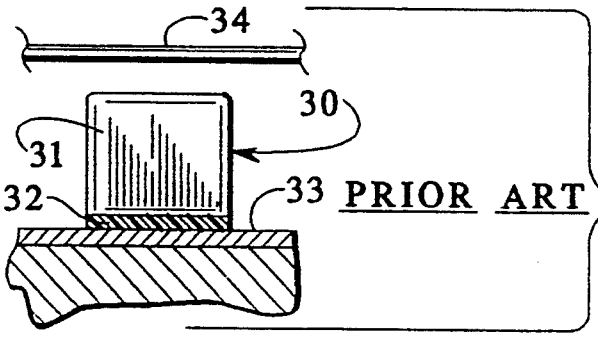
FIG. 3

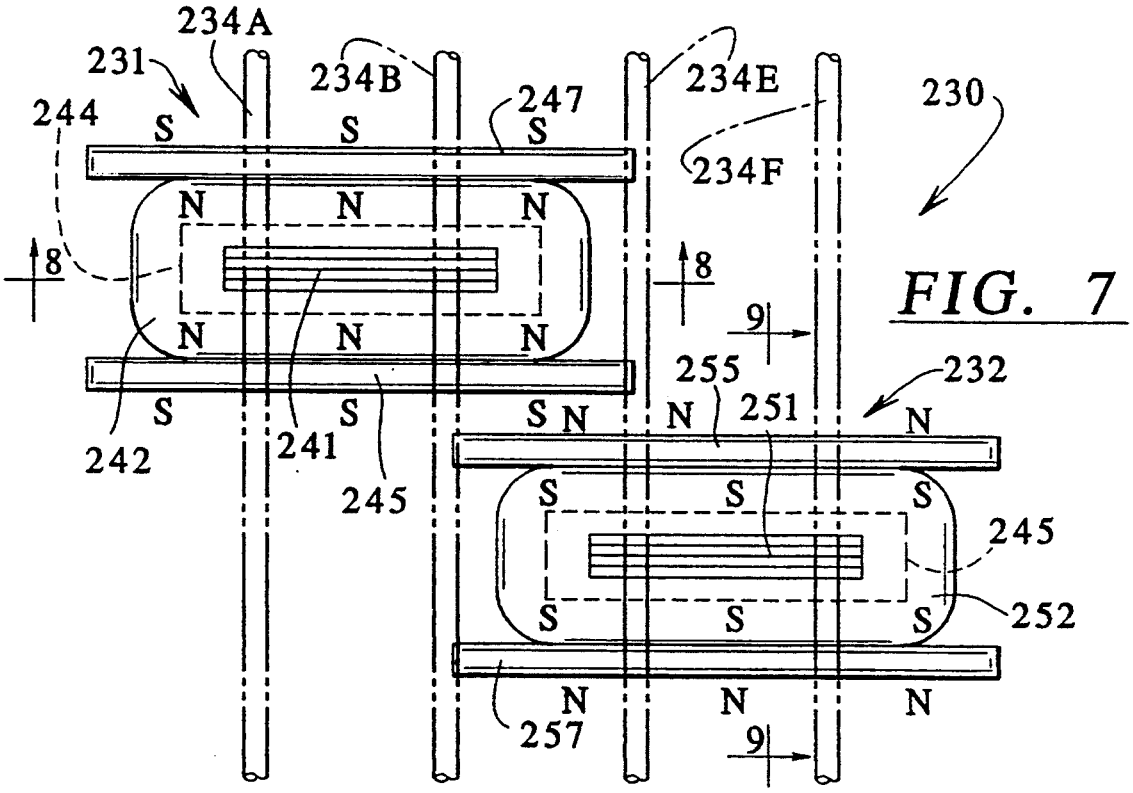
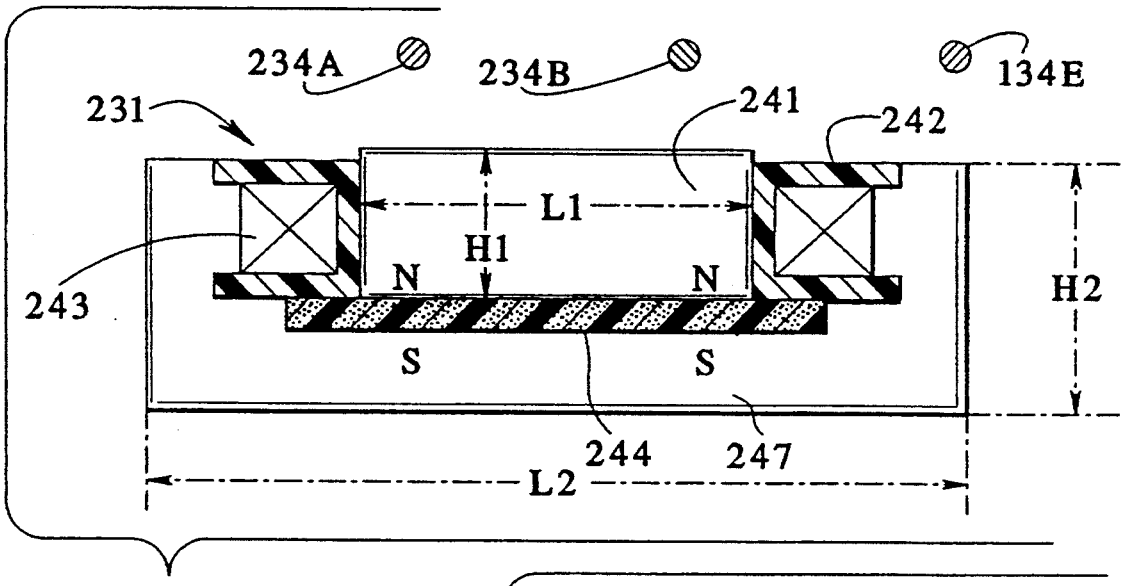
FIG. 8
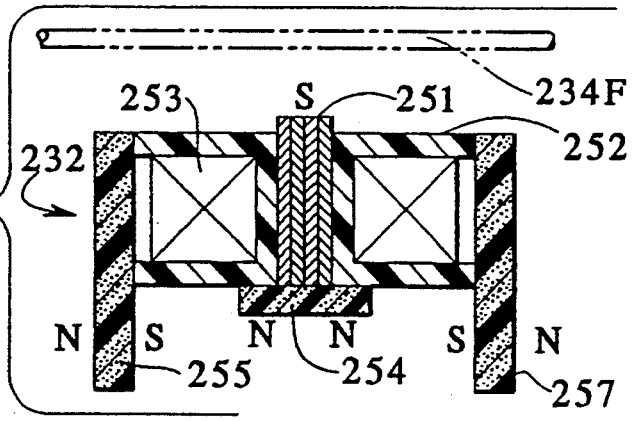
FIG. 9

ELECTROMAGNETIC MUSICAL PICKUP USING MAIN AND AUXILIARY PERMANENT MAGNETS

This application is a continuation-in-part of application Ser. No. 08/000,202 filed Jan. 4, 1993, which was a continuation-in-part of two prior applications, Ser. No. 07/764,346 filed Sep. 23, 1991 and Ser. No. 07/900,485 filed Jun. 18, 1992 now U.S. Pat. No. 5,221,805; those two applications were continuations-in-part of a further prior application, Ser. No. 07/597,899 filed Oct. 10, 1990. Applications Ser. Nos. 07/764,346 and 07/597,899 have been abandoned.

BACKGROUND OF THE INVENTION

For many years, electromagnetic signal pickups have been utilized on musical instruments having ferromagnetic strings. Such pickups have been employed with guitars, bass guitars, banjos, mandolins, violins and a variety of other instruments. A pickup for a musical instrument that uses ferromagnetic strings almost invariably incorporates a magnetic structure for generating a magnetic field that encompasses the strings. That magnetic structure usually includes at least one permanent magnet and may include at least one high-permeability ferromagnetic pole piece. Frequently, the pickup has a separate pole piece or permanent magnet for each string; thus, a guitar pickup may have six pole pieces or six magnets, one for each string. On the other hand, some electromagnetic pickups have a single pole piece that spans a number of strings, often all of the strings of the instrument. The pickup may have an electrical pickup coil for each string, or it may have one electrical pickup coil that generates a composite all-string signal.

The electrical signals from the coil or coils are amplified and reproduced by a speaker or other transducer that functions as the output of the musical instrument. The electrical pickup coils are customarily disposed in encompassing relation to the magnetic cores; when there are plural coils each coil usually has its own core. This relatively simple electromagnetic structure is fitted into a housing. The housing may or may not be a part of the magnetic structure. Whether or not it is a part of the magnetic structure, a principal purpose of the housing is to protect the pickup from dirt and other contaminants and to mount the pickup on the instrument.

A wide variety of individual constructions have been used for electromagnetic pickups employed with musical instruments such as guitars. Frequently, the efforts of the pickup designer have been directed toward achieving an output signal from the electrical coil that is as close as possible to a faithful reproduction of the sound that would be developed by the instrument functioning as an acoustical device. This is not always the case, however; many electromagnetic pickups have been designed to give a particular distortion deemed desirable by the designer or by a musician.

For electromagnetic pickups in general, as applied to musical instruments having steel or other ferromagnetic strings, there may be some difficulty in obtaining an output signal of sufficient amplitude. This may be a minor problem, with modern electronic technology, because even a very weak signal can often be amplified to an adequate amplitude. On the other hand, a reasonable output amplitude from the pickup itself is desirable because it reduces the necessity for subsequent amplification, and thus reduces the likelihood of inadequately controlled distortion. Moreover, with adequate initial amplitude of the signal generated by the pickup, the signal-to-noise ratio is increased so that a "purer" signal can be realized.

A pronounced problem, in many electromagnetic pickups for musical instruments, has to do with the frequency response. The overall "sound" derived from the output signal is usually critical to the requirements of the musician. Some musicians want to have the output signal as close as possible to the acoustic output of the instrument, at least in theory. Others, however, want to have a distortion that is acceptable to them, one that represents their own concept or technique for interpretation of music. The frequency response characteristics of the pickup are critical in this regard. A similar situation is presented by the sound characteristic known to musicians as "sustain"; sometimes accented "sustain" is desirable in the view of the musician using the pickup and sometimes it is not.

SUMMARY OF THE INVENTION

It is a primary object of the invention, therefore, to provide a new and improved electromagnetic pickup, for a musical instrument having a plurality of ferromagnetic strings, which affords improved initial amplitude and a favorable signal-to-noise ratio and that can generate signals having a broad range of frequency and "sustain" characteristics.

A specific object of the invention is to provide a new and improved electromagnetic pickup for a plural ferromagnetic stringed musical instrument that affords a high amplitude output signal, despite substantial variations in the construction and operation of the pickup itself, and that can produce a variety of different frequency effects in its output signal.

Another object of the invention is to provide a new and improved electromagnetic pickup for a plural ferromagnetic stringed instrument, particularly a guitar, that is simple and inexpensive in construction, that can be readily mounted upon the guitar, and that has a virtually indefinite life.

Accordingly, the invention relates to an electromagnetic pickup for a musical instrument, such as a guitar, having a number of ferromagnetic strings; the pickup comprises an elongated high permeability ferromagnetic core, having a length L1 sufficient to span a plurality of less than all of the musical instrument strings, a height H1, and a width W1. A multi-turn electrically conductive pickup coil is disposed in encompassing relation to the ferromagnetic core and a main permanent magnet, formed of a first permanent magnet material having a first high energy product, is disposed in alignment with one elongated edge of the core; the main permanent magnet is magnetized in a direction transverse to the core height to maintain a given constant magnetic polarity in the core. The pickup further includes auxiliary permanent magnet means, comprising at least one elongated auxiliary permanent magnet, formed of a second permanent magnet material having an energy product substantially less than the first energy product, disposed immediately adjacent one side of the pickup coil; the auxiliary permanent magnet has a length L2 greater than L1 and a height H2 at least as large as H1. The pickup includes means for mounting the core, the coil, the main permanent magnet, and the auxiliary permanent magnet on the musical instrument with the core and the coil spanning a plurality of less than all of the ferromagnetic strings, in spaced relation thereto, and with the strings passing through a magnetic field afforded by the main permanent magnet and the core so that movement of any of these strings generates an electrical signal in the coil. The pickup is usually included in a pickup assembly that includes one or more additional similar pickups, so that the assembly covers all of the instrument strings.

BRIEF DESCRIPTION OF THE DRAWINGS

FIG. 1 is a plan view of an electromagnetic musical pickup assembly, specifically a guitar pickup, of the kind to which the invention is directed;

FIG. 2 is a side elevation view of the apparatus of FIG. 1;

FIG. 3 is a section view taken approximately along line 3—3 in FIG. 2;

FIG. 7 is a plan view, housing omitted, of another embodiment of the invention as applied to a four-string instrument such as a banjo or bass guitar;

FIGS. 8 and 9 are sectional views taken approximately as indicated by lines 8—8 and 9—9 in FIG. 7;

DESCRIPTION OF THE PREFERRED EMBODIMENTS

Figure 4:
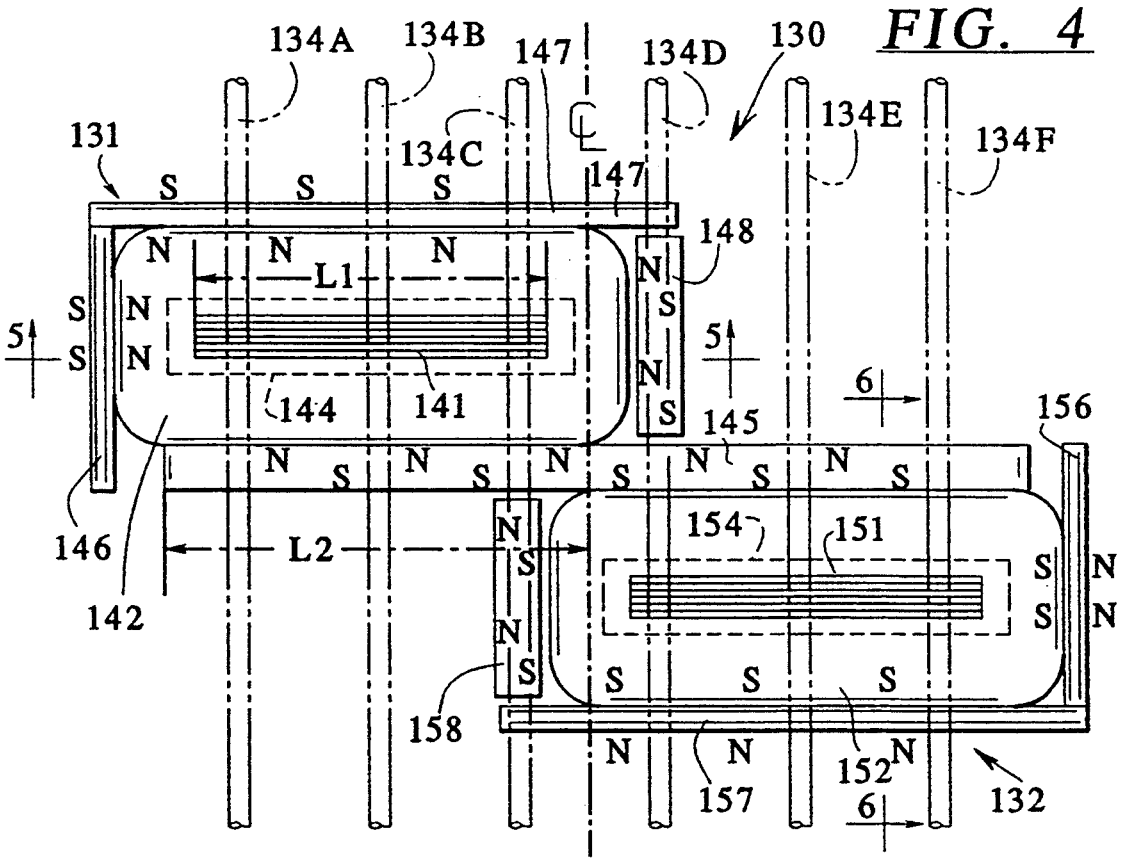
FIG. 4 is a plan view, with the housing omitted, of an electromagnetic musical pickup assembly, specifically a pickup assembly for a six-string guitar, constructed in accordance with one embodiment of the invention.

FIGS. 1–3 illustrate an electromagnetic guitar pickup assembly 30 that may be deemed generally representative of prior art pickups but that also applies generally to the electromagnetic musical pickup assemblies of the present invention. Typically, pickup assembly 30 comprises a housing 31 having a base plate 32 that may be integral with the housing. Housing 31 may be made of steel or of a permanent magnet material if it is used as an operating component of pickup assembly 30; the housing may be of a magnetically inert plastic if it is not a working electromagnetic component of the pickup. Pickup assembly 30 is mounted on the top 33 of a musical instrument having a plurality of ferromagnetic strings 34. As illustrated, strings 34 are the strings of a guitar and extend across but in spaced relation to the top surface 33 of the guitar neck or body, depending upon where the pickup assembly 30 is mounted. Strings 34 are distributed across a total span S, FIG. 1, usually with approximately equal spacing between the strings. Screws or other appropriate mounting devices 35 are utilized to mount pickup 30 on guitar body 33.

A wide variety of different electromagnetic sensing devices have been utilized in prior art embodiments of pickup 30; consequently, no specific operating structure is shown in FIGS. 1–3. On the other hand, it may be noted that any known construction for electromagnetic pickup 30 would include a magnetic structure for generating one or more magnetic fields that encompass the ferromagnetic strings 34. A structure of this sort, in the known prior art devices, customarily includes at least one permanent magnet and may include at least one high permeability ferromagnetic pole piece. For the electromagnetic pickup 30 shown in FIGS. 1–3, utilizing known constructions, the internal assembly could include six pole pieces, or six magnets, one for each string 34. On the other hand, some forms of electromagnetic pickup have utilized a single pole piece or core that extends the length of the pickup, beneath all of the musical strings 34.

In any of the known forms of electromagnetic pickup there is at least one electrical pickup coil, not shown in FIGS. 1–3; there may be separate coils for each of the strings 34, usually with all of those coils electrically connected together. The entire pickup assembly, including the pole piece or pieces, the permanent magnet or magnets, and the electrical pickup coil or coils, is disposed in housing 31. Vibrations of the musical instrument strings 34, both vertically and horizontally, generate electrical signals in the coil or coils within housing 31, and it is those signals that are amplified and reproduced, as by one or more speakers, to afford an output from the musical instrument in conventional manner.

Figure 5:
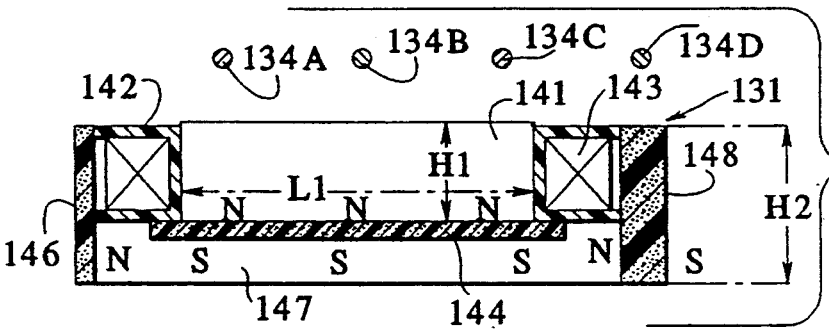
FIG. 5 is a longitudinal sectional view taken approximately along line 5—5 in FIG. 4.
Figure 6:
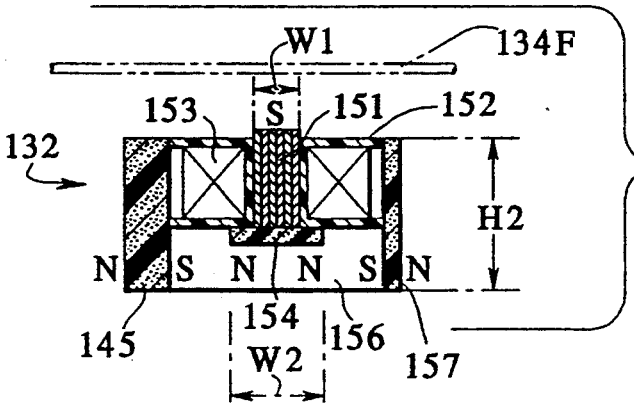
FIG. 6 is a transverse sectional view taken approximately along line 6—6 in FIG. 4.

FIGS. 4–6 illustrate the operating components of an electromagnetic musical pickup assembly 130 constructed in accordance with one embodiment of the present invention. Pickup assembly 130 includes two pickups 131 and 132 that are physically similar but magnetically inverted relative to each other. Pickup 131 includes an elongated, high permeability ferromagnetic core 141 that extends for a length L1 sufficient to span three of the guitar strings 134A, 134B and 134C. In this instance, it is assumed that pickup 130 is used for a six string guitar. As illustrated, there are six thin sheet steel laminations in core 141, but the number of laminations may vary typically; two to eight thin steel laminations may be utilized. A solid, unlaminated ferromagnetic member may also be employed as core 141. A coil form 142 is mounted on and encompasses the central ferromagnetic core 141; an electrically conductive pickup coil 143 (FIG. 5) is mounted in coil form 142, thus being disposed in encompassing relation to core 141. Pickup coil 143 generates an electrical signal representative of movements of any of the strings 134A, 134B, or 134C, or any combination of those three strings.

The core and coil construction used in pickup 132 of assembly 130 is a duplicate of that for pickup 131. Thus, there is an elongated, high permeability ferromagnetic core 151 in pickup 132 that has a length L1 sufficient to span the other three guitar strings 134D, 134E, and 134F (FIG. 4). A coil form 152 is mounted on and encompasses core 151; a conductive electrical coil 153 disposed within coil form 152 generates electrical signals representative of movements of any of the strings 134D, 134E, or 134F, or any combination of those strings.

Two elongated main permanent magnets 144 and 154 are mounted in the pickups 131 and 132, respectively. Each main permanent magnet extends along the bottom of one of the cores 141 and 151 and preferably contacts its associated core (FIGS. 4–6). The main permanent magnet 144 of pickup 131 is magnetized transversely so that its entire upper surface facing and engaging core 141 is a north pole; see FIG. 5. The main permanent magnet 154 of pickup 132, on the other hand, is magnetized in the opposite direction so that its upper surface facing core 151 constitutes a continuous south pole; see FIG. 6. Permanent magnets 144 and 154 are used as the main driving magnets for coils 143 and 153; conjointly, they produce magnetic fields encompassing all of the guitar strings 134A–134F.

A first auxiliary permanent magnet 145 (FIG. 1) spans the entire length of pickup assembly 130 and constitutes a part of each of the pickups 131 and 132. This auxiliary permanent magnet 145 is transversely magnetized, as indicated in FIGS. 4 and 6; it affords a continuous north pole surface facing toward coil 143 and core 141 of pickup 131, and a continuous south pole facing coil 153 and core 151 of the other pickup 132.

There are three more auxiliary permanent magnets 146, 147 and 148 included in the first pickup 131, one magnet on each of the three remaining sides of core 141 and coil form 142 (and coil 143) not covered by the auxiliary permanent magnet 145. See FIGS. 4 and 4. Each of the auxiliary permanent magnets 146–148 is transversely magnetized and presents a continuous north pole facing the central core and coil of pickup 131. The height H2 for each of the auxiliary magnets 145–148 is the same; that height H2 is preferably appreciably greater than the core height H1. The length L2 of the auxiliary permanent magnet 145 facing core 141 (see FIG. 4) is greater than the core length L1; the overall length of the auxiliary permanent magnet 147 on the opposite side of assembly 131 is even larger.

Three auxiliary permanent magnets 156, 157 and 158 are included in the other pickup 132, one on each side of the ferromagnetic core 151 not facing the auxiliary permanent magnet 145 that is common to both pickups in assembly 130. These three auxiliary permanent magnets 156–158 are each transversely magnetized to present a continuous south pole facing core 151 and coil 153. As in the first pickup, the heights H2 of the auxiliary magnets exceed the height of core 151.

The preferred permanent magnet material for all of the auxiliary permanent magnets 145–148 and 156–158 comprises a low energy product resin material, preferably relatively flexible and slightly elastomeric, that is impregnated with particulate permanent magnet material. Such permanent magnet resin sheets are readily available commercially. One form of appropriate flexible permanent magnet resin material is made and sold by 3M Company under the trademark PLASTIFORM; another flexible resin permanent magnet material that may be utilized in device 130 for the auxiliary permanent magnets is made and sold by B.F. Goodrich Company under the trademark KOROSEAL. Yet another such material is available from The Electrodyne Company of Batavia, Ohio under the designation PLASTALLOY. All of these permanent magnet materials have a moderate induction level or maximum energy product, in a range of about $1.1\times10^6$ to $1.9\times10^6$. This permanent magnet material is adequate for the auxiliary permanent magnets and is quite inexpensive.

The main permanent magnets 144 and 154, however, should be substantially stronger than the auxiliary permanent magnets; they provide the main, working magnetic fields of pickup 130. That is, the main permanent magnets 144 and 154 should have an induction level or maximum energy product that is substantially higher than the auxiliary permanent magnets 145–148 and 156–158. A commercially available material, comprising an elastomeric resin and magnetic particle complex, that has the desired maximum energy product, at least $9\times10^6$, is available from The Electrodyne Company of Batavia, Ohio, under the designation REANCE 90.

The preferred wire size for coils 143 and 153 is forty six gauge or larger copper wire. Larger wire sizes result in better high frequency response. A range of 38 to 46 gauge is preferred. For the ferromagnetic cores 141 and 151, No. 1008 steel is quite satisfactory, particularly if laminated cores are used; other steels or other ferromagnetic materials can also be used.

The electromechanical musical pickup assembly 130 of FIGS. 4–6 produces a high amplitude output signal, usually three to four times the amplitude obtainable with previously known pickups, particularly guitar pickups. Even when the auxiliary magnets 146–148 and 156–158 are omitted, so that there are no external ferromagnetic shields around the outside of pickup assembly 130, that assembly exhibits an excellent signal-to-noise ratio. Hum pickup from external sixty Hertz fields and the like is virtually non-existent; the output signals from coil 143 and 153 are not distorted by such hum. All of the materials employed in pickup assembly 130 are commercially available, although coils 143 and 153 are usually wound to particular specifications and the dimensions of the laminations used in cores 141 and 151 must also be established. The core laminations in a guitar pickup, using No. 1008 steel, may have a length L1 of 2.22 inches (5.64 cm), a height H1 of 0.42 inch (1.07 cm) and a thickness of 0.02 to 0.025 inch (0.125 cm). Typically, the auxiliary permanent magnets 146–148 and 156–158 are 0.03 inch (0.075 cm) in thickness. The central auxiliary permanent magnet 145 may have a thickness of 0.06 inch (0.15 cm); two layers can be used. Length L2 may be 2.65 inches (6.35 cm) and height H2 may be 0.75 inch (1.9 cm).

Some modifications of the specific pickup construction illustrated in FIGS. 4–6 can be carried out, with no more than minor degradation of the output signal. In particular, and as previously noted, the end auxiliary magnets 146, 148, 156 and 158 can be eliminated; pickup assembly 130 will continue to operate in a manner similar to that obtained when those shield magnets are present. However, there may be some increase in noise or hum in the output signals if these auxiliary magnets are not present, and amplitude may be reduced somewhat.

FIGS. 7–9 illustrate the operating components of another electromagnetic musical pickup assembly 230 constructed in accordance with the invention, in views similar to FIGS. 4–6. Pickup 230 includes two pickups 231 and 232. As before, the pickups 231 and 232 are physically similar but magnetically inverted relative to each other. Thus, pickup 231, FIGS. 7 and 8, includes a laminated high permeability ferromagnetic core 241 on which a coil form 242 is mounted. There is an electrically conductive pickup coil 243 in coil form 242; see FIG. 8. An elongated main permanent magnet 244 is mounted immediately below and preferably in contact with the bottom of the ferromagnetic core 241 of pickup 231. The main permanent magnet 244 of pickup 231 in assembly 230, as best seen in FIG. 8, is magnetized transversely so that the surface of the main permanent magnet 244 facing core 241 and coil 243 presents a continuous north magnetic pole. The length of the main permanent magnet 244 is substantially greater than the core length L1; the main permanent magnet 244 is also preferably wider than core 241. Assembly 231 serves two of four ferromagnetic strings, strings 234A and 234B, as in a banjo or a bass guitar.

In the other pickup 232 of assembly 230 (FIGS. 7 and 9) there is an elongated, laminated, high permeability ferromagnetic core 251 like core 241. Core 251 is positioned in the central aperture of a plastic or paper coil form 252 in which an electrically conductive pickup coil 253 is wound. A main permanent magnet 254 is located immediately below the ferromagnetic core 251, preferably in contact with the core; the main magnet 254 is transversely magnetized to present a continuous south pole facing core 251, so that the upper surface of core 251 is also a south pole. Pickup 232 is aligned below the remaining strings 234E and 234F of the musical instrument; see FIG. 7. Thus, in pickup assembly 230 the coil 243 of pickup 231 generates electrical signals representative of movements of either of the strings 234A and 234B, or both of them; the coil 253 of pickup 232 develops electrical signals responsive to movements of either or both of the other strings 234E and 234F.

Pickup 231 of assembly 230, FIGS. 7 and 8, further comprises two auxiliary permanent magnets 245 and 247 located on opposite long sides of coil form 242 in parallel spaced relation to opposed long sides of core 241. Each of these two auxiliary permanent magnets 245 and 247 (they may appropriately be referred to as shield magnets) is transversely magnetized to present a continuous north pole surface facing toward coil 243 and core 241. These auxiliary permanent magnets 245 and 247 each have a length L2 (see FIG. 8) greater than the core length L1; moreover, their height H2 is greater than the core height H1. Pickup 232 includes two similar shield magnets 255 and 257 having the same characteristics as auxiliary magnets 245 and 247 except that the direction of magnetization is reversed so that each of the shield magnets 255 and 257 has a continuous south pole surface facing coil 253 and core 251.

With coils 243 and 253 of pickups 231 and 232 connected to each other in a conventional humbucker configuration, the signal-to-noise ratio of pickup 230 is high and there is virtually no hum in the output signals from the pickup coils. The signal output from device 230, however, produced by vibration of any one or any combination of the ferromagnetic strings 234A, 234B, 234E or 234F in the magnetic fields of the pickup assembly 230, is appreciably higher in amplitude than with conventional pickups. Indeed, an increase in amplitude of three to four times is readily realized. Moreover, both sections of pickup assembly 230 are well protected against internal vibrational feedback and microphonic effects by the auxiliary shield magnets 245, 247, 255 and 257, though perhaps not quite as well as the more fully shielded pickup assemblies of FIGS. 4–7.

A further modification of pickup assembly 230, FIGS. 7–9, entails reversing the polarization of one main permanent magnet, such as main magnet 254, to have the same polarization as the other main magnet 244. For this modification, the outer shield magnets 255 and 257 for the second pickup 232 of assembly 230 should also be reversed in polarization. The result is a pickup assembly that still has a high amplitude output and is protected against vibrational feedback and microphonic effects.

Figure 10:
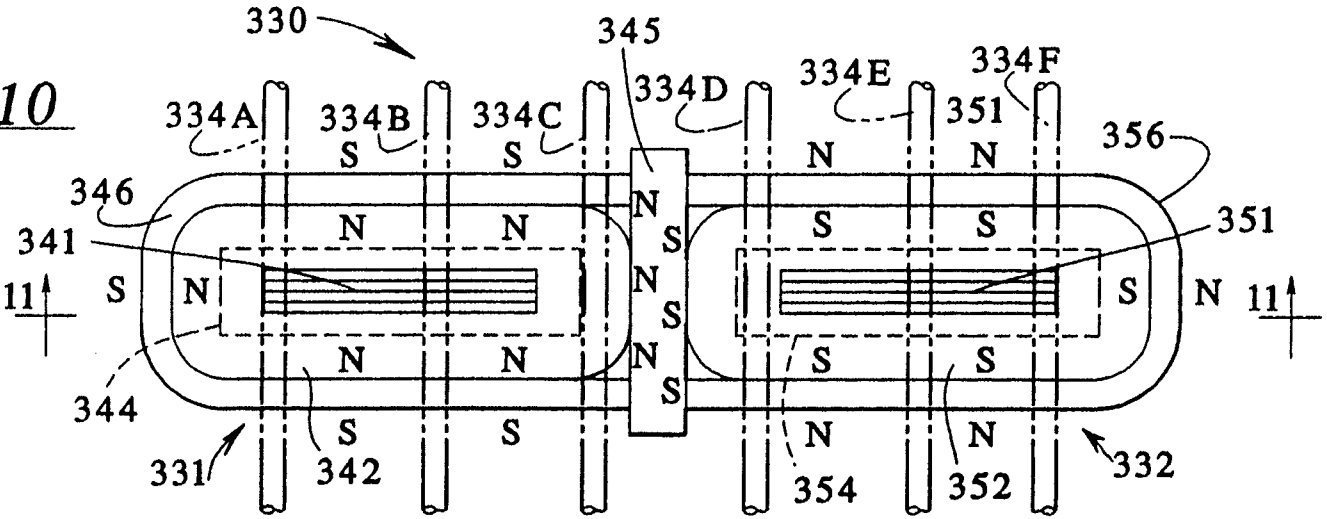
FIG. 10 is a plan view, housing omitted, of a further embodiment of the invention comprising a pickup assembly for a six-string guitar.
Figure 11:
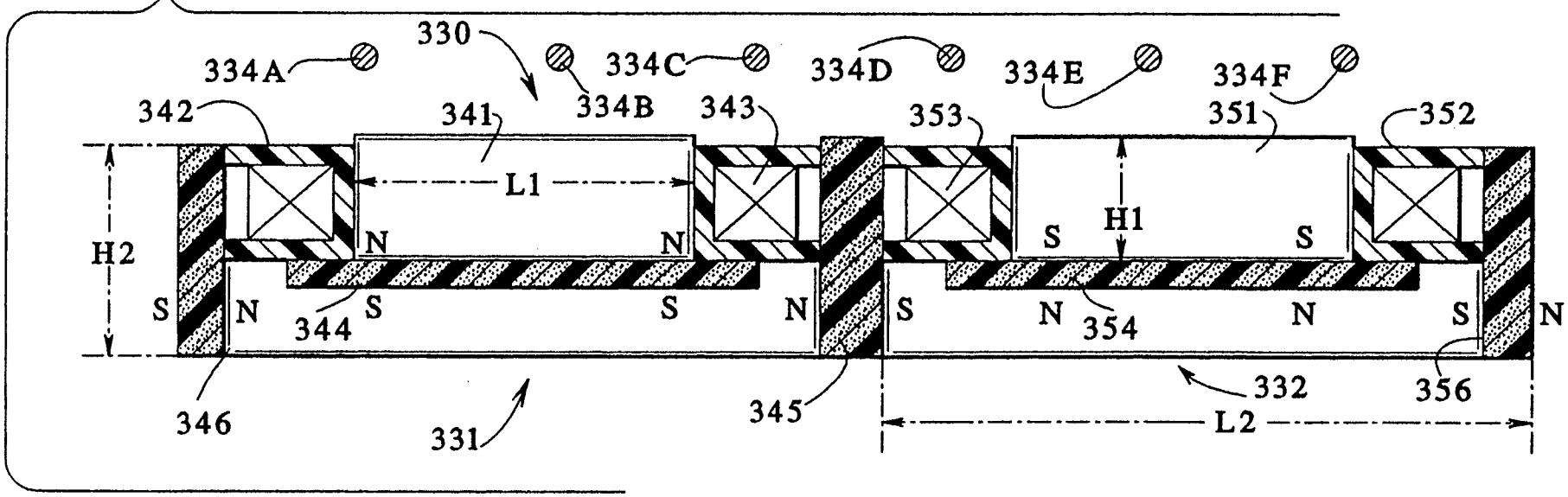
FIG. 11 is a sectional view taken approximately along line 11—11 in FIG. 10.

Yet another electromagnetic musical pickup assembly 330, constructed in accordance with a further embodiment of the invention, is shown in FIGS. 10 and 11. Pickup assembly 330 includes two pickups 331 and 332 of similar construction. Pickup 332, however, is inverted in magnetic polarization as compared to pickup 331.

Pickup 331 comprises an elongated, laminated, high permeability ferromagnetic core 341 encompassed by a coil form or bobbin 342 with an electrical pickup coil 343 (FIG. 11) mounted in the bobbin. The other pickup 332 includes an elongated ferromagnetic core 351 mounted centrally of a coil form 352 in which an electrically conductive pickup coil 353 (FIG. 11) is mounted. An auxiliary permanent magnet, the shield magnet 345, is mounted in the center of pickup assembly 331, between the coil forms 342 and 352. An auxiliary permanent magnet shield 346 of U-shaped configuration is included in pickup 331, enclosing the three sides of that pickup not covered by auxiliary magnet 345. The auxiliary permanent magnets 345 and 346 are polarized so that each presents a continuous north pole face to coil 343. A U-shaped auxiliary permanent magnet 356 in the other pickup 332 serves the same purpose as magnet 346; the auxiliary magnets 345 and 356 are polarized to present a continuous south pole facing all sides of coil form 352 and pickup coil 353. The auxiliary permanent magnets 346 and 356 each have a length L2 larger than the core length L1 and all of the auxiliary magnets preferably have a height H2 greater than the core height H1 (FIG. 11).

Pickup assembly 330 further comprises two main permanent magnets 344 and 354 in the base of the pickup assembly. The main permanent magnet 344 of pickup 331 is located at the left-hand side of the pickup, as shown in FIGS. 10 and 11, preferably immediately below and in contact with ferromagnetic core 341. This main permanent magnet 344 is polarized, as shown in FIG. 11, to present a continuous north pole surface engaging the lower surface of its associated ferromagnetic core 341. The other main permanent magnet 354, in pickup 332, is similar except that it engages the bottom of the second ferromagnetic core 351 at the right-hand side of the pickup assembly 330 and presents a continuous south pole surface in engagement with that core. Pickup assembly 330 is shown as used with a six-string guitar; core 341 spans three strings 334A–334C and core 351 spans the other three strings 334D–334F.

Like the previously described dual coil pickup assembly 230 of FIGS. 7–9, assembly 330 of FIGS. 10 and 11 generates a high amplitude output signal from its two pickup coils 343 and 353. If those two coils are connected in the usual humbucker configuration so that they cancel extraneous hum or noise, the output signal developed in response to vibration or any of the ferromagnetic strings 334A–334F, or any combination thereof, is of substantial amplitude but has little or no hum content. The signal-to-noise ratio is excellent. As in the case of the pickup assembly 130 shown in FIGS. 4–6, the auxiliary permanent magnets 345, 346 and 356 shield all sides of the two pickup coils 343 and 353. Each pickup coil, in every illustrated embodiment of the invention, is immersed in a unipolar magnetic field.

For all embodiments of the invention the parameters of individual components referred to in connection with FIGS. 4–6 are preferred. Main permanent magnet materials with high energy product (BxH as referred to above) enhance and improve output amplitude. The auxiliary permanent magnets, on the other hand, should utilize materials of lower energy product; such materials are less expensive but afford effective shielding against external fields, physical vibrations, etc., that is as good as the more expensive high-energy permanent magnets.

In each of the various embodiments of the invention shown in FIGS. 4–11, the ferromagnetic pickup cores are illustrated as being of laminated construction, either six laminations (FIGS. 4 and 6) or four laminations (FIGS. 7, 9 and 10). This is the preferred construction, but unlaminated cores can be used if preferred. For laminated cores, No. 1008 sheet steel is preferred; others may be used. For unlaminated cores, virtually any high permeability steel can be utilized; even sintered iron is usable.

For all embodiments of the invention, FIGS. 4–11, only the electromagnetic operating components of the pickups have been illustrated. Housings or other mounting means have not been shown. All embodiments, however, require a housing or some other means to mount the operating components of the pickups in the required relationship to the ferromagnetic strings of a guitar or other musical instrument; see FIGS. 1–3. Thus, the strings must pass through the magnetic field afforded by the main permanent magnet and core of any of these pickups if the pickup is to function effectively.

I claim:

1. An electromagnetic pickup for a musical instrument, such as a guitar, having a given number of ferromagnetic strings, the pickup comprising:

an elongated high permeability ferromagnetic core, having a length L1 sufficient to span a plurality of less than all of the musical instrument strings, a height H1, and a width W1;

an elongated electrically conductive pickup coil disposed in encompassing relation to the ferromagnetic core;

a main permanent magnet, formed of a first permanent magnet material having a first high energy product, disposed in alignment with one elongated edge of the core, the main permanent magnet being magnetized in a direction transverse to the core height to maintain a given constant magnetic polarity in the core;

auxiliary permanent magnet means, comprising at least one elongated auxiliary permanent magnet, formed of a second permanent magnet material having an energy product materially lower than the first energy product, disposed immediately adjacent one side of the pickup coil, the auxiliary permanent magnet having a length L2 greater than L1 and a height H2 at least as large as H1;

and means for mounting the core, the coil, the main permanent magnet, and the auxiliary permanent magnet on the musical instrument with the core and the coil spanning a plurality of less than all of the ferromagnetic strings, in spaced relation thereto, and with that plurality of strings passing through a magnetic field afforded by the main permanent magnet and the core so that movement of any string of the plurality of strings generates an electrical signal in the coil.

2. An electromagnetic pickup for a ferromagnetic string musical instrument, according to claim 1, in which the core includes a plurality of ferromagnetic sheet steel laminations each having a thickness no greater than about 0.025 inch (0.06 cm).

3. An electromagnetic pickup for a ferromagnetic string musical instrument, according to claim 1, in which the electrical pickup coil is formed of 46 gauge or larger copper wire.

4. An electromagnetic pickup for a ferromagnetic string musical instrument, according to claim 1, in which the auxiliary permanent magnet means comprises a plurality of auxiliary permanent magnets.

5. An electromagnetic pickup for a ferromagnetic string musical instrument, according to claim 1, in which the auxiliary permanent magnet means covers both long sides of the pickup coil.

6. An electromagnetic pickup for a ferromagnetic string musical instrument, according to claim 1, in which the auxiliary permanent magnet means covers all sides of the pickup coil.

7. A dual coil electromagnetic pickup assembly for a musical instrument, such as a guitar, having a given number of ferromagnetic strings, the pickup assembly comprising:

first and second elongated high permeability ferromagnetic cores, each core having a length L1 sufficient to span a plurality of less than all the ferromagnetic strings, and a smaller height H1, the cores spanning all of the strings of the instrument;

first and second elongated electrically conductive pickup coils, each coil disposed in encompassing relation to one of the ferromagnetic cores;

first and second main permanent magnets, each formed of a first permanent magnet material having a first high energy product, each main permanent magnet disposed in alignment with one elongated edge of one of the cores and magnetized in a direction transverse to its associated core height, for maintaining a given constant magnetic polarity in the associated core;

auxiliary permanent magnet means, comprising at least one elongated auxiliary permanent magnet formed of a second permanent magnet material having an energy product materially lower than the first energy product, the auxiliary permanent magnet having a height H2 at least as large as H1 and being disposed immediately adjacent one side of each pickup coil;

and means for mounting the core, the coil, the main permanent magnet, and the auxiliary permanent magnet means on the musical instrument with each core and its associated coil spanning a plurality of less than all of the ferromagnetic strings in spaced relation thereto and with each plurality of strings passing through a magnetic field afforded by the main permanent magnet and the core related to that plurality of strings so that movement of any string of the plurality generates an electrical signal in the associated coil.

8. A dual-coil electromagnetic pickup assembly for a ferromagnetic string musical instrument, according to claim 7, in which each core includes a plurality of ferromagnetic sheet steel laminations, each lamination having a thickness no greater than about 0.025 inch (0.06 cm).

9. A dual-coil electromagnetic pickup assembly for a ferromagnetic string musical instrument, according to claim 7, in which the auxiliary permanent magnet means includes a plurality of auxiliary permanent magnets, each magnetized transversely and each presenting a surface, facing its associated core and pickup coil, having the same polarity as the polarity of the main permanent magnet engaging the edge of the core encompassed by that coil, so that each core is enclosed by surfaces of the same magnetic polarity on all sides.

10. A dual-coil electromagnetic pickup assembly for a ferromagnetic string musical instrument, according to claim 9, in which one auxiliary permanent magnet serves both pickup coils.

11. An electromagnetic pickup assembly for a ferromagnetic string musical instrument, according to claim 7, in which the polarities of the first and second main permanent magnets are oriented oppositely to each other.

12. A dual coil electromagnetic pickup assembly for a musical instrument, such as a guitar, having a plurality of ferromagnetic strings, the pickup assembly comprising:

first and second elongated ferromagnetic cores, each core having a length L1 sufficient to span a plurality of the musical instrument strings and a smaller height H1;

first and second electrically conductive pickup coils, each disposed in encompassing relation to one of the ferromagnetic cores;

the first core and coil being displaced longitudinally from the second coil and core, transversely of the strings, with each string aligned with at least one coil;

first and second permanent magnet means, each including a main permanent magnet disposed immediately adjacent one elongated edge of a respective one of the cores and magnetized in a direction transverse to the height of its associated core, for maintaining a given constant polarity in the associated core;

and auxiliary permanent magnet means, including at least a first auxiliary permanent magnet adjacent a side of the first coil and first core and a second auxiliary magnet adjacent a side of the second coil and second core, each auxiliary magnet being magnetized transversely and presenting a surface, facing its associated pickup coil, having the same polarity as the polarity of the main permanent magnet adjacent the edge of the core encompassed by that coil.

13. An electromagnetic pickup assembly for a ferromagnetic string musical instrument, according to claim 12, in which the first coil and core is further displaced longitudinally of the strings relative to the second coil and core.

14. An electromagnetic pickup assembly for a ferromagnetic string musical instrument, according to claim 12, in which the first and second auxiliary permanent magnets constitute a single permanent magnetic member that is aligned adjacent both the first coil and core and the second coil and core.

15. An electromagnetic pickup assembly for a ferromagnetic string musical instrument, according to claim 12, in which the first and second main permanent magnets are oriented so that they are polarized oppositely to each other.

* * * * *